US012146384B2

(12) United States Patent
Quero et al.

(10) Patent No.: US 12,146,384 B2
(45) Date of Patent: Nov. 19, 2024

(54) SINGLE TRIP WELLBORE CLEANING AND SEALING SYSTEM AND METHOD

(71) Applicant: Halliburton Energy Services, Inc., Houston, TX (US)

(72) Inventors: Philippe Quero, Houston, TX (US); Harley Jones, II, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 88 days.

(21) Appl. No.: 18/073,352

(22) Filed: Dec. 1, 2022

(65) Prior Publication Data

US 2023/0099838 A1 Mar. 30, 2023

Related U.S. Application Data

(63) Continuation-in-part of application No. 17/124,212, filed on Dec. 16, 2020, now Pat. No. 11,542,777.

(51) Int. Cl.

| | |
|---|---|
| ***E21B 33/16*** | (2006.01) |
| ***E21B 33/127*** | (2006.01) |
| ***E21B 34/06*** | (2006.01) |

(52) U.S. Cl.

CPC ..... *E21B 33/16* (2013.01); *E21B 33/1275* (2013.01); *E21B 34/063* (2013.01)

(58) Field of Classification Search

CPC ..... E21B 33/16; E21B 33/1275; E21B 34/063
See application file for complete search history.

(56) References Cited

U.S. PATENT DOCUMENTS

| | | | | |
|---|---|---|---|---|
| 3,721,297 | A | 3/1973 | Challacombe | |
| 4,076,457 | A | 2/1978 | Skinner et al. | |
| 5,320,182 | A * | 6/1994 | Mendez | E21B 33/1275 166/66.4 |
| 5,377,753 | A | 1/1995 | Haberman et al. | |

(Continued)

FOREIGN PATENT DOCUMENTS

| | | | |
|---|---|---|---|
| CN | 2693945 | Y | 4/2005 |
| CN | 201428423 | Y | 3/2010 |

(Continued)

OTHER PUBLICATIONS

International Search Report and Written Opinion issued in related PCT Application No. PCT/US2020/066417 dated Sep. 3, 2021, 12 pages.

(Continued)

*Primary Examiner* — Aaron L Lembo
(74) *Attorney, Agent, or Firm* — Thomas Rooney; C. Tumey Law Group PLLC

(57) ABSTRACT

A downhole tool for cleaning and sealing a wellbore includes a wash tool configured at a downhole end of the downhole tool to generate pulses of a first fluid at a first frequency and a first pressure for washing a target interval of a wellbore. The downhole tool further includes a plugging tool configured uphole or downhole from the wash tool to generate pulses of a second fluid at a second frequency and a second pressure for depositing a sealing plug at the target interval of the wellbore. The second fluid has a higher viscosity than the first fluid, the second frequency is lower than the first frequency, and the second pressure is higher than the first pressure.

18 Claims, 7 Drawing Sheets

(56) References Cited

U.S. PATENT DOCUMENTS

| | | | | |
|---|---|---|---|---|
| 5,577,560 | A * | 11/1996 | Coronado | E21B 23/08 166/66.4 |
| 6,279,670 | B1 | 8/2001 | Eddison et al. | |
| 9,045,958 | B2 | 6/2015 | Eddison | |
| 2010/0310384 | A1 | 12/2010 | Stephenson et al. | |
| 2014/0083689 | A1 | 3/2014 | Streich et al. | |
| 2016/0138391 | A1 | 5/2016 | Logan et al. | |
| 2017/0211349 | A1 | 7/2017 | Themig et al. | |
| 2018/0252069 | A1 | 9/2018 | Abdollah et al. | |
| 2020/0123894 | A1 | 4/2020 | Ross et al. | |
| 2020/0173249 | A1 | 6/2020 | Fairweather | |
| 2020/0173251 | A1 | 6/2020 | Shafer | |
| 2024/0044228 | A1* | 2/2024 | Yerubandi | E21B 49/00 |

FOREIGN PATENT DOCUMENTS

| | | | |
|---|---|---|---|
| WO | 2015066804 | A1 | 5/2015 |
| WO | 2017043977 | A1 | 3/2017 |
| WO | 2018224819 | A1 | 12/2018 |
| WO | 2020081236 | A1 | 4/2020 |
| WO | 2020185229 | A1 | 9/2020 |
| WO | 2020246959 | A1 | 12/2020 |

OTHER PUBLICATIONS

Notice of Allowance for U.S. Appl. No. 17/124,212 dated Sep. 19, 2022.
Final Office Action for U.S. Appl. No. 17/124,212 dated Jun. 2, 2022.
Office Action for U.S. Appl. No. 17/124,212 dated Jan. 5, 2022.

* cited by examiner

SINGLE TRIP WELLBORE CLEANING AND SEALING SYSTEM AND METHOD

CROSS-REFERENCE TO RELATED APPLICATIONS

The present application is a continuation-in-part of U.S. patent application Ser. No. 17/124,212, the entire disclosure of which is incorporated herein by reference.

TECHNICAL FIELD

The present disclosure relates generally to a system and method for cleaning and sealing a wellbore. More specifically, though not exclusively, the present disclosure relates to systems and methods that prepare a wellbore for sealing, and thereafter, seal the wellbore in a single trip within the wellbore.

BACKGROUND

When a well (or zone) reaches the end of its lifetime, it should be permanently plugged and abandoned. Such plug and abandonment (P&A) operations usually include placing one or more wellbore seals (e.g., cement plugs) in the wellbore to isolate the reservoir and other fluid-bearing formations in order to avoid unwanted fluid communication between a formation surrounding the wellbore and a surface of the wellbore. To abandon the wellbore, a multi-step abandonment process is typically executed. For example, the wellbore may be cleaned near a desired location of the wellbore seal. Additionally, wellbore casing may be perforated to provide sealing communication between the wellbore and the formation (and/or between casings). Further, the desired location may be conditioned for sealing and the sealing material such as cement may be installed to seal the wellbore for abandonment.

In operation, each of these steps of the multi-step abandonment process is typically implemented with a separate run into the wellbore. For example, each of the steps may involve a different tool placed at the end of a jointed pipe (or coiled tubing whichever the case may be) and a different process associated with the individual step. Between the steps, the tool may be removed from the wellbore and replaced with a tool associated with a subsequent step of the abandonment process. The cycle of inserting and removing tools into and from the wellbore may be repeated multiple times until the abandonment process is completed. Additionally, some abandonment techniques may involve leaving or otherwise abandoning tool components downhole within the wellbore, and some of the abandonment techniques may require the use of jointed pipe (or coiled tubing) for deployment of the tools.

BRIEF DESCRIPTION OF DRAWINGS

Some specific exemplary aspects of the disclosure may be understood by referring, in part, to the following description and the accompanying drawings.

Figure 1A:
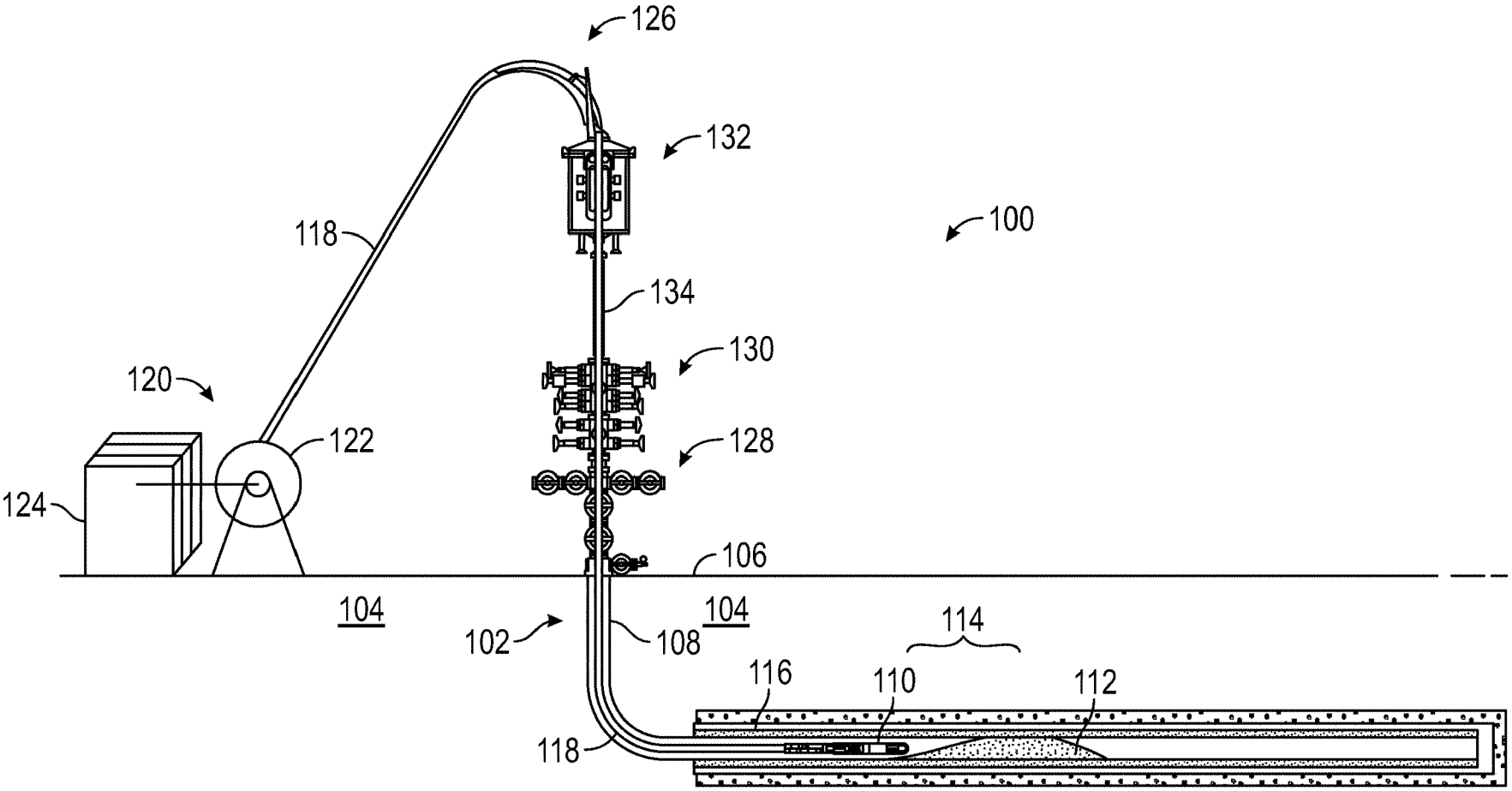
FIG. 1A is a cross-sectional schematic view of an example of a wellbore environment, in accordance with certain aspects of the present disclosure.

While aspects of this disclosure have been depicted and described and are defined by reference to exemplary aspects of the disclosure, such references do not imply a limitation on the disclosure, and no such limitation is to be inferred. The subject matter disclosed is capable of considerable modifications, alterations, and equivalents in form and function, as will occur to those skilled in the pertinent art and having the benefit of this disclosure. The depicted and described aspects of this disclosure are examples only, and not exhaustive of the scope of the disclosure.

DETAILED DESCRIPTION

Aspects of the present disclosure relate to systems and methods for preparing an oil and gas wellbore for abandonment. More specifically, though not exclusively, certain aspects of the present disclosure relate to systems and methods that prepare the wellbore for sealing, and thereafter, seal the wellbore in a single trip within the wellbore.

In one or more aspects, a downhole tool assembly includes a wash tool and a plugging tool. The wash tool prepares a target interval within the wellbore for installation of a cement plug by cleaning perforations previously created in a well casing of the wellbore by a perforating tool. Once the perforations have been cleaned, the plugging tool may be used to deposit a seal (e.g., cement plug) at the target interval in a manner that prevents unwanted communication of fluids between the formation surrounding the wellbore and/or a portion of the wellbore and a surface of the wellbore. As described in accordance with certain aspects of the present disclosure, the disclosed downhole tool assembly is capable of performing the wash operation and the plugging operation in a single trip within the wellbore.

A single trip or run into the wellbore may refer to a downhole tool performing multiple operations within the wellbore without being removed from the wellbore between individual operations. In some examples, the downhole tool assembly may include other tools that may complement the wash tool and the cementing tool, including, but limited to, tools that clean blockages from a path within the wellbore and create perforations on a casing within the wellbore, all in a single trip within the wellbore.

For example, a downhole tool assembly according to some examples may include several tools operating as a bottom hole assembly. Each of the tools of the downhole tool assembly may perform an operation associated with preparing a target interval of the wellbore for sealing or sealing the wellbore at the target interval. For example, a cleaning tool may clean the wellbore during a run-in operation to remove debris from a target interval for installation of a cement plug. A perforating tool may perforate or slot the casing within the wellbore to provide sealing communication between the cement plug and a formation surrounding the wellbore. Further, an additional cleaning tool (e.g., the wash tool) may clean perforating debris from the target interval, and a plugging tool may provide material for a sealing plug (e.g., cement plug) to the target interval within the wellbore. These operations may be performed by a single bottom hole assembly on a single run into the wellbore. Further, the downhole tool may be delivered downhole within the wellbore using coiled tubing, which may enable installation of the cement plug within a live well.

The downhole tool assembly in accordance with certain aspects of the present disclosure provides several advantages over the existing downhole tools for preparing a wellbore for sealing and for sealing the wellbore.

Current market solutions for P&A operations are complex, expensive and may require multiple trips into the wellbore to complete plugging of the wellbore. For example, most commercially available tools used in P&A operations have complicated designs and constructions, and thus, are expensive to manufacture. The downhole tool assembly according to certain aspects of the present disclosure has a simple design and construction, and thus, is easy to manufacture leading to lower costs. Additionally, the downhole tool assembly is a single trip tool which further reduces costs.

Commercially available P&A tools are also slower to deploy in the wellbore and most often need expert personnel at location to run and monitor the tools. For example, most existing P&A downhole tool assemblies include a cup tool that needs to be lowered slowly in the wellbore to avoid damaging the cup tool. Further, owing to their complex design and construction, existing P&A tools need expert personnel on location to run and monitor the tools.

To the contrary, owing to a simple design and construction, the downhole tool assembly in accordance with certain aspects of the present disclosure is faster to deploy in the wellbore. For example, in some embodiments, the downhole tool assembly does not include a cup tool and thus can be lowered relatively faster in the wellbore than existing P&A tools. Further, the simple design and construction makes the downhole tool assembly easy to operate. Thus, the downhole tool assembly requires reduced or no expert personnel at location to operate the downhole tool assembly.

Some commercially available cleaning tools use fluidic oscillator technology to create bursts of pulsating pressure waves of low viscosity fluids such as acid or brine, enabling pinpoint placement of the fluid to treat the near-wellbore area and help restore maximum injection. The fluid pulses provide higher injectivity for better penetration of the acid and brine into tight spaces within perforations to provide better cleaning. However, these cleaning tools do not work with high viscosity fluids such as cement.

Some existing cementing tools include cup packers that are designed to force cement into the perforations with high pressure only. However, relying on pressure alone to force the high viscosity cement into the perforations does not work well to inject the fluid in tiny spaces within the perforations and micro annulus in the wellbore so that the fluid occupies the tiny spaces to provide a better seal. It has been found that pulsing the cement may provide higher injectivity and penetration to the cement allowing the cement to be reliably injected into tight spaces within the perforations and micro annulus in the wellbore to provide better sealing. However, existing tools do not have the capability to pulse high viscosity fluids such as cement.

The downhole tool assembly in accordance with certain aspects of the present disclosure includes a plugging tool that can generate low frequency and high amplitude (e.g., high pressure) pulses of high viscosity fluids such as cement to provide better injectivity and penetration of the high viscosity fluids into perforations and micro annulus within the wellbore. Thus, the plugging tool provides a better seal as compared to the existing sealing tools.

Additionally or alternatively, in certain aspects, the discussed downhole tool assembly provides enhanced perforation cleaning using the wash tool with a high frequency jetting system for brine or acid placement in combination with enhanced cement bond with low frequency high amplitude (e.g., high pressure) jetting system for cement placement using the plugging tool.

Additional advantages of the downhole tool assembly in accordance with certain aspects of the present disclosure include no requirement of pipe movement for tool activation, no requirement of ball drops for tool activation and a substantially mechanical system with little to no electronic components.

Illustrative aspects of the present disclosure are described in detail herein. In the interest of clarity, not all features of an actual implementation may be described in this specification. It will of course be appreciated that in the development of any such actual aspect, numerous implementation specific decisions are made to achieve the specific implementation goals, which will vary from one implementation to another. Moreover, it will be appreciated that such a development effort might be complex and time-consuming, but would, nevertheless, be a routine undertaking for those of ordinary skill in the art having the benefit of the present disclosure.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1A is a cross-sectional schematic view of an example of a wellbore environment 100, in accordance with certain aspects of the present disclosure. When a well 102 is damaged or otherwise unusable, operations may be performed on the well 102 to either remediate the damage or to abandon the well 102. Remediating the well may involve installing cement within the wellbore to repair a damaged section of casing. The added layer of cement may maintain integrity of the damaged casing during future operations. Further, when an oil and gas well is no longer in use, plugging and abandonment (P&A) operation may be performed. Abandonment may involve ending unwanted fluid communication between a formation 104 surrounding the well 102 and a surface 106 of the well 102. To end this fluid communication between the formation 104 and the surface 106, a cement plug in sealing communication with the formation 104 may be installed within a wellbore 108 of the well 102.

A downhole tool assembly 110 (e.g., a bottom hole assembly) may be used to prepare the wellbore 108 for installation of the cement plug and also for the installation of the cement plug within the wellbore 108. For example, the downhole tool assembly 110 may include multiple tools or subs capable of performing varying operations for installation of the cement plug within the wellbore 108. In an example, the downhole tool assembly 110 may include a cleaning tool capable of cleaning debris 112 from the wellbore 108 when the downhole tool assembly 110 is run into the wellbore 108.

Figure 1B:
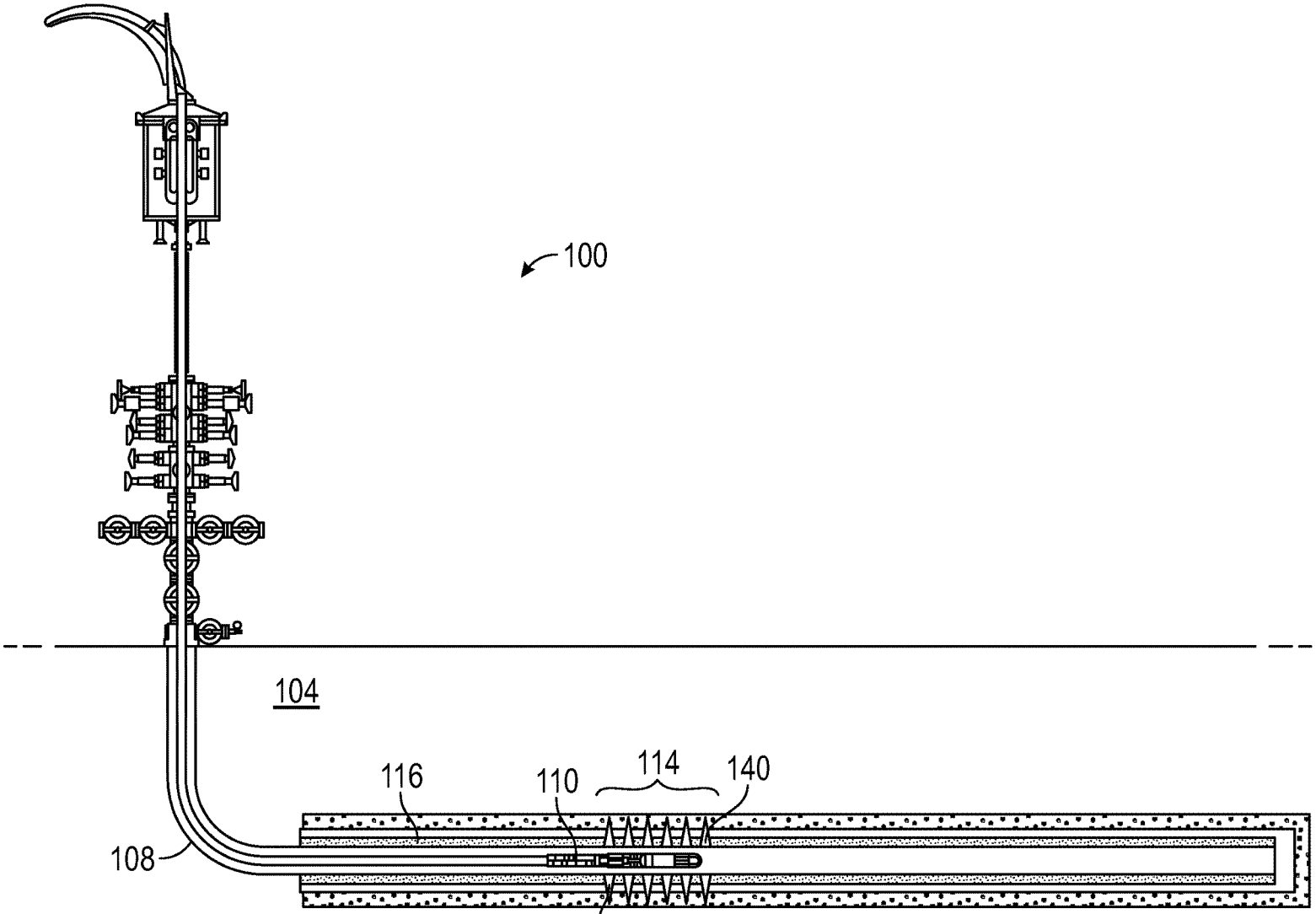
FIG. 1B is a cross-sectional view of the wellbore environment of FIG. 1A during a perforating stage, in accordance with certain aspects of the present disclosure.

The downhole tool assembly 110 may further include a perforating tool which, once the downhole tool assembly 110 reaches a target interval 114 of the wellbore 108, may perform a perforating or slotting operation through a casing 116 to create a path for the cement plug to achieve sealing communication with the formation 104. In an example, the target interval 114 may be a location at which the cementing plug is installed. In one example, an abrasive slurry may be pumped through the perforating tool through at least one hydraulic jet toward the casing 116 at high flow rate to generate perforations or slots within the casing 116. The perforations or slots eventually enable a sealing communication between the cement plug and the formation 104. Other examples of the perforating tool may include explosive, mechanical, or chemical methods to create the perforations or slots. FIG. 1B is a cross-sectional view of the wellbore environment 100 of FIG. 1A during a perforating stage. As shown, perforations 140 have been created through the casing 116 by a perforating tool of the downhole tool assembly 110 to eventually provide sealing communication between the cement plug and the formation 104.

The downhole tool assembly 110 may further include a wash tool which, after perforating or slotting the casing 116, may clean perforation debris away from the perforations or slots 140 in the casing 116 using fluid oscillator technology. Cleaning the debris from the perforations or slots 140 in the casing 116 may prepare the target interval 114 for the cementing process associated with installing the cement plug. In an example, the wash tool may jet oscillating water, brine, spotting acid, solvent, or other cleaning agents at the target interval 114 to remove any perforating debris or material buildup away from the target interval 114. By removing the debris and buildup from the target interval 114, sealing communication between the cement plug and the formation 104 may be improved.

Figure 1C:
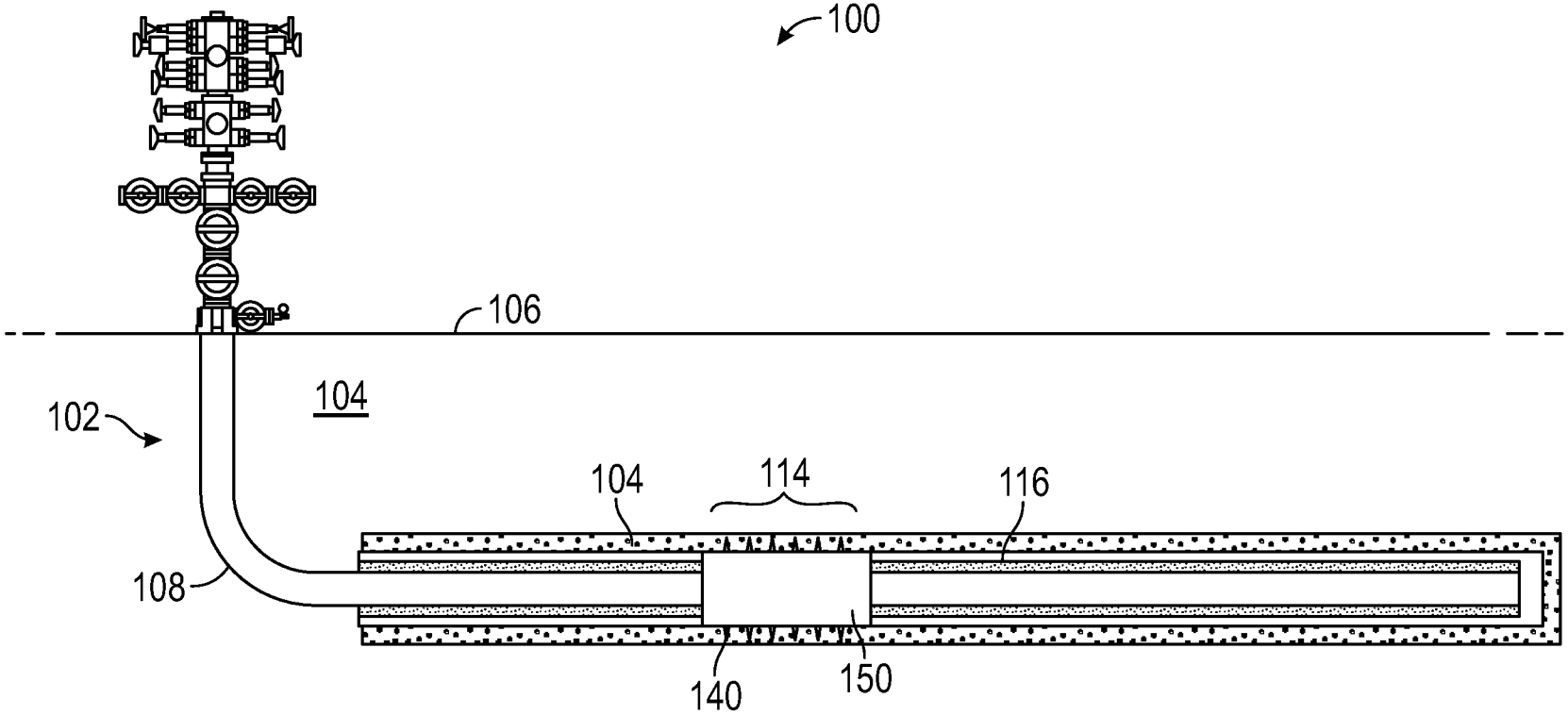
FIG. 1C is a cross-sectional view of the wellbore environment of FIG. 1A upon completion of installation of a cement plug, in accordance with certain aspects of the present disclosure.

The downhole tool assembly may further include a plugging tool which, after the perforations have been cleaned, may place a cement plug at the target interval 114 in sealing communication with the formation 104. In one example, one or more large flow ports of the plugging tool may layer or otherwise place the cement for the cement plug at the target interval 114. While the cement plug is described herein as being made of cement, a sealant plug or plug made from a sealant combined with cement may also be used. In an example, the sealant may be a hardening resin capable creating sealing communication with the formation 104 surrounding the wellbore 108. FIG. 1C is a cross-sectional view of the wellbore environment 100 of FIG. 1A upon completion of installation of a cement plug, in accordance with certain aspects of the present disclosure. As shown, a cement plug 150 is installed at interval 114 within the wellbore 108 providing sealing communication between the formation 104 and the wellbore 108.

It may be noted that while the downhole tool assembly 110 is discussed as having each of a cleaning tool, a perforating tool, a wash tool, and a plugging tool, a skilled person may appreciate that the downhole tool assembly 110 may include any one or more of these tools and may further include additional tools to complement one or more of these tools.

As illustrated, the downhole tool assembly 110 is coupled to an end of coiled tubing 118. The coiled tubing 118 may be deployed with the downhole tool assembly 110 into the wellbore 108 using a coiled tubing system 120. In an example, the coiled tubing system 120 may include a reel 122 that stores unused coiled tubing 118 and turns to inject or retract the coiled tubing 118 within the wellbore 108. The coiled tubing system 120 may also include multiple fluid storage tanks 124. The fluid storage tanks 124 may store fluid provided by the coiled tubing system 120 to the downhole tool assembly 110 to clean the wellbore 108, to perforate or slot the casing 116, to clean debris and buildup from the slotted or perforated areas of the casing 116, to install a cement plug, or any combination thereof.

When deploying the downhole tool assembly 110 into the wellbore 108 using the coiled tubing system 120, the coiled tubing may be run through a gooseneck 126. The gooseneck 126 may guide the coiled tubing 118 as it passes from a reel orientation in the reel 122 to a vertical orientation within the wellbore 108. In an example, the gooseneck 126 may be positioned over a wellhead 128 and a blowout preventer 130 using a crane (not shown).

The gooseneck 126 may be attached to an injector 132, and the injector 132 may be attached to a lubricator 134, which is positioned between the injector 132 and the blowout preventer 130. In operation, the injector 132 grips the coiled tubing 118 and a hydraulic drive system of the injector 132 provides an injection force on the coiled tubing 118 to drive the coiled tubing 118 within the wellbore 108. The lubricator 134 may provide an area for staging tools (e.g., the downhole tool assembly 110) prior to running the tools downhole within the wellbore 108 when the wellbore 108 represents a high-pressure well. Further, the lubricator 134 provides an area to store the tools during removal of the tools from the high-pressure well. That is, the lubricator 134 provides a staging area for injection and removal of tools into and from a high-pressure well (e.g., a live well).

While the wellbore environment 100 is depicted as using the coiled tubing 118 to install the downhole tool assembly 110 within the wellbore 108, other tool conveyance systems may also be employed. For example, the wellbore environment 100 may include a jointed pipe system to install the downhole tool assembly 110 within the wellbore 108. Additionally, while the wellbore environment 100 is depicted as a land-based environment, the downhole tool assembly 110 may also be similarly introduced and operated in a subsea based environment.

Figure 2A:
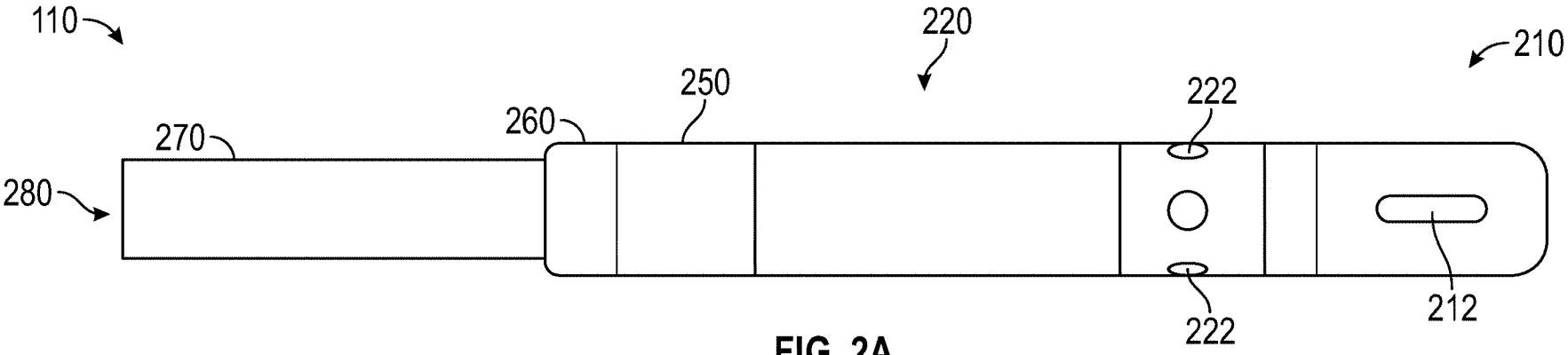
FIG. 2A is a schematic view of an example of the downhole tool assembly, in accordance with certain aspects of the present disclosure.

FIG. 2A is a schematic view of an example of the downhole tool assembly 110, in accordance with certain aspects of the present disclosure. As shown, at the downhole end of the example downhole tool assembly 110 a wash tool 210 is installed. A plugging tool 220 may be positioned uphole from the wash tool 210. A rupture or flapper disk 250 may be optionally positioned uphole from the plugging tool 220. The downhole tool assembly 110 including the wash tool 210, the plugging tool 220 and the optional rupture/flapper disk 250 may also include a connector 260 positioned at an uphole end of the downhole tool assembly 110. The connector 260 may connect the downhole tool assembly 110 with a work string (e.g., the coiled tubing 118, jointed pipe, etc.). Further, the connector 260 may be any type of connector to suit a particular work string of the wellbore environment 100.

In one or more aspect, the wash tool 210 may use fluid oscillator technology to clean debris from perforations or slots 140 in the casing 116 in order to prepare the target interval 114 for the cementing process associated with installing the cement plug. For example, the wash tool 210 may jet oscillating water, brine, spotting acid, solvent, or other cleaning agents at the target interval 114 to remove any perforating debris or material buildup away from the target interval 114. By removing the debris and buildup from the target interval 114, sealing communication between the cement plug and the formation 104 may be improved.

The perforations or slots 140 may have been previously created in the casing 116 at the target interval 114 of the wellbore 108 by using a perforating tool. The perforating tool may perform a perforating or slotting operation through the casing 116 to create a path for the cement plug, when installed, to achieve sealing communication with the formation 104. In certain aspects, the perforating tool may be a separate tool that is used to perforate the casing 116 in a separate run of the perforating tool into the wellbore 108. In certain alternative aspects, the perforating tool may be part of the example downhole tool assembly 110 and may be installed at the downhole end of the downhole tool assembly 110 positioned downhole from the wash tool 210. In this case, the downhole tool assembly 110 may perforate the casing 116, wash the perforations 140 and cement the wellbore 108 in a single run into the wellbore 108.

After the perforating or slotting operation is completed by a perforating or slotting tool, a low viscosity fluid such as brine or acid may be pumped in the flow direction 280 through the coiled tubing 270 into the downhole tool assembly 110. The low viscosity fluid flows through the plugging tool 220 into the wash tool 210 and is diverted to one of more oscillating side ports 212 of the wash tool 210. The oscillating side ports 212 transmit fluid into the wellbore 108 in an oscillating manner to provide a thorough flush of the perforations or slots 140 cut through the casing 116. For example, the oscillating fluid may flow through the oscillating side ports 212. The fluid that flows through the oscillating side ports 212 may include any low viscosity fluid including, but not limited to a spotting acid, a solvent, or another cleaning agent to remove buildup, scale, or any other debris from within the wellbore 108 or from the formation 104. Further, the fluid flowing through the oscillating side ports 212 may place a conditioning treatment within the perforations or slots 140 to prepare the target interval 114 for subsequent material placement (e.g., installation of the cement plug). In one or more aspects, wash tool 210 may provide the fluid with pulsating resonance as a cyclic output. For example, the cyclic output may include high frequency pulses (e.g., 100 Hz to 300 Hz) at low fluid pressure amplitude with a flow rate in the range of 0.25 barrels (bbl)/min and 10 bbl/min. The high frequency low pressure fluid pulses output from the oscillating side ports 212 may help break up any consolidated fill within the perforations or the slots 140, and the pulse and flow aspect of the cyclic output may also provide an ability to flush any fill from irregular channels or profiles of the perforations or the slots 140. Further, when the wash tool 210 is operated where a hydrostatic load is present, the cyclic output may also create a localized Coriolis force around the downhole tool assembly 110. This may ensure a full coverage flush across the target interval 114. While the wash tool 210 is depicted, other cleaning tools capable of cleaning or otherwise pre-treating the target interval 114 may also be used. Further, the downhole tool assembly 110 may be moved uphole and downhole in several passes along the interval 114 within the wellbore 108 to flush an entirety of the target interval 114. It may be noted that the numeral ranges of the various parameters (e.g., frequency, pressure, flow rate etc.) discussed in this disclosure are exemplary and various tools can be tuned or adapted to implement other numerical ranges of the parameters.

The plugging tool 220 is designed to place a cement plug at the target interval 114 in sealing communication with the formation 104. In one or more aspects, once the perforations 140 have been cleaned by the wash tool 210, cement may be pumped via the coiled tubing 270 into the downhole tool assembly 110. The cement may exit one or more cement ports 214 of the plugging tool 220 into the wellbore 108 and occupy the target interval 114 of the wellbore to provide the sealing communication with the formation 104. In one or more aspects, the plugging tool 220 can generate low frequency and high amplitude (e.g., high pressure) pulses of high viscosity fluids such as cement slurry to provide better injectivity and penetration of the high viscosity fluids into perforations 140 and micro annulus within the wellbore. This allows the plugging tool to provide a better seal as compared to the existing plugging tools. For example, the plugging tool 220 may produce fluid pulses with frequency ranging from 1 to 20 Hz, fluid pressure ranging from 500 to 2000 PSI and flow rate of the fluid ranging from 0.5 to 10 bbl/min.

Figure 2B:
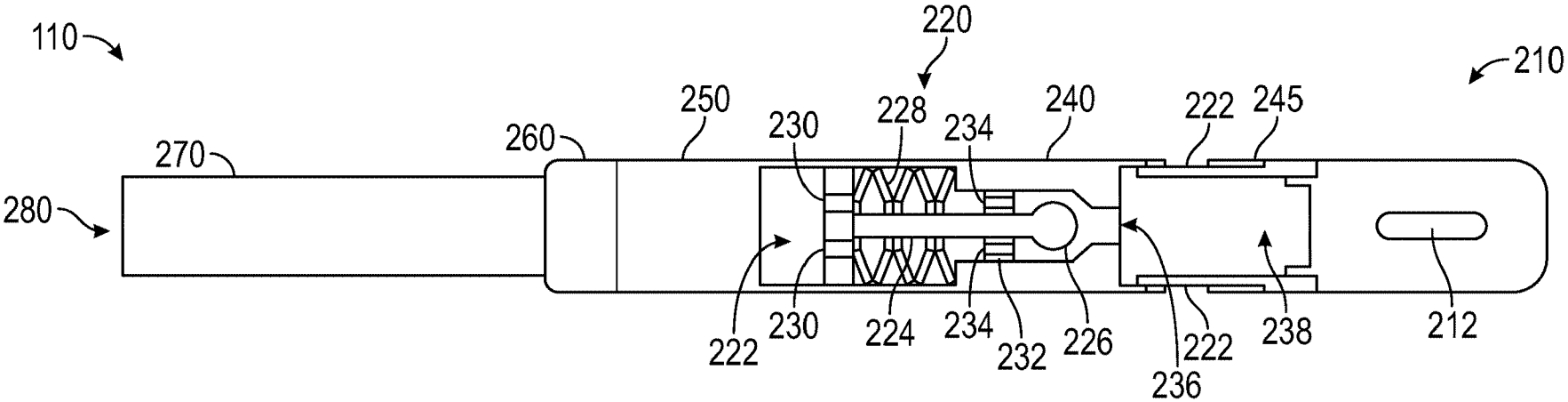
FIG. 2B is a cross-sectional view of a portion the downhole tool assembly showing the internal construction of the plugging tool, in accordance with certain aspects of the present disclosure.

FIG. 2B is a cross-sectional view of a portion the downhole tool assembly 110 showing the internal construction of the plugging tool 220, in accordance with certain aspects of the present disclosure. As shown in FIG. 2B, the plugging tool 220 includes a low frequency generator 240 and a pressure activated sleeve unit 245. The low frequency generator 240 is designed to generate low frequency and high-pressure pulses of a high viscosity fluid such as cement slurry. The pressure activated sleeve 245 is designed to deliver the cement to the target interval 114 via the cement ports 214.

The pressure activated sleeve 245 is designed to open the cement ports 214 (and optionally, to also close the side ports 212) when fluid pressure inside chamber 238 of the pressure activated sleeve 245 increases beyond a threshold pressure rating of the pressure activated sleeve. The threshold pressure rating of the pressure activated sleeve 245 is set above the maximum fluid pressure at which the wash tool 210 operates to avoid the sleeve 245 from activating during normal operation of the wash tool 210. In one or more aspects, the pressure activated sleeve 245 may include one or more shear pins (not shown) that are designed to shear when pressure inside the chamber 238 increases beyond the threshold pressure rating of the sleeve 245. The sleeve 245 may be configured to open in response to the one or more shear pins shearing.

In one or more aspects, when the wash tool 210 has finished cleaning the perforations 140, the pumping rate of the low viscosity cleaning fluid (e.g., acid, brine etc.) used to clean the perforations 140 may be significantly increased to increase the fluid pressure in chamber 238 beyond the rated threshold pressure of the sleeve 245 and thus opening the pressure activated sleeve 245 to allow fluids to exit through the cement ports 214 (and optionally, to also close flow through the side ports 212). In alternative aspects, when the wash tool 210 has finished cleaning the perforations 140, cement may be pumped into the downhole tool assembly 110. Since the sleeve 245 is closed at this point, the cement flow is unable to exit via the cement ports 214 and proceeds to the wash tool 210 and attempts to exit via the ports 212 of the wash tool 210. However, ports 212 are not designed to pass a high viscosity fluid such as cement. For example, ports 212 are sized to allow passing of lower viscosity fluids only such as brine and acid. The ports 212 are not sufficiently large to allow a high viscosity fluid to pass freely through the ports 212. Thus, the cement is unable to freely exit from the ports 212 of the wash tool 210 which leads to cement pressure building up in the chamber 238. With more cement flowing into the downhole tool assembly 110, cement pressure in the chamber 238 eventually rises beyond the rated threshold pressure of the pressure activated sleeve 245 thus opening the pressure activated sleeve 245 to allow the cement to exit through the cement ports 214.

As shown in FIG. 2B, the low frequency generator 240 includes a floating piston assembly including a piston base 222, a piston shaft 224 and a piston head 226. The piston assembly is designed to move laterally along the length of the low frequency generator 240. A neck portion of the piston shaft 224 near the piston head 226 is supported by a stabilizer 232. The stabilizer 232 is designed to allow lateral movement of the piston shaft 224 while supporting the piston shaft 224. As shown, a spring 228 is positioned between the piston base 222 and the piston head 226 such that the spring 228 pushes against the piston base 222 away from opening 236 that allows cement to flow from the low frequency generator 240 into the chamber 238 of the pressure activated sleeve unit 245. In a fully open position of the spring 228, the piston base 222 is pushed to its leftmost position such that the piston head 226 does not obstruct the opening 236. The piston base 222 includes one or more ports 230 to allow cement to flow downhole thorough the piston base 222. Similarly, the stabilizer 232 includes one or more ports 234 to allow cement to flow downhole through the stabilizer 232.

When cement slurry is pumped into the low frequency generator 240, the cement starts flowing through the low frequency generator 240 via the opening 236 into the chamber 238 and out of cement ports 214. However, owing to the high viscosity of the cement, the flow of cement creates a differential pressure across the piston base 222 which pushes the piston base 222 in the downhole direction. As the piston assembly moves in the downhole direction, the piston base 222 presses the spring 218 and eventually the piston head 226 seals against the opening 236 obstructing the flow of cement from the low frequency generator 240 to the chamber 238. Once the flow of cement is interrupted through the low frequency generator 240, the differential pressure across the piston base 222 drops allowing the spring 228 to push back the piston base 222 to its leftmost initial position. This moves the piston head 226 away from the opening 236 allowing the cement to again flow through to the chamber 238 and out of the cement ports 214. As long as the cement is pumped into the low frequency generator 240 and cement flow is maintained, the piston assembly continuously cycles through the above steps to generate low frequency and high pressure pulses of cement that are delivered through the cement ports 214.

In one or more aspects, the resistance of the spring 228 may be set high enough so that low viscosity wash fluids (e.g., acid, brine etc.) flowing through the low frequency generator 240 to the wash tool 210 do not activate the piston assembly allowing low viscosity fluids to flow freely through the low frequency generator 240 to the wash tool 210.

In one or more aspects, while some cement may leak through ports 212 of the wash tool 210, since the ports 212 are not designed to deliver high viscosity fluids such as cement and are too small to support a constant flow of cement, the wash tool 210 resists cement from exiting from the wash tool 210 via the ports 212. This allows sufficient pressure to build up in the chamber 238 for cement pulses to exit from the cement ports 214.

In one or more aspects, the plugging tool 220 may optionally include a flapper or rupture disk 250 positioned uphole from the plugging tool 220 in order to free the coiled tubing 270 of any blockages resulting, for example, from accumulation of fluids such as cement or other debris in the downhole tool assembly 110. In one example, fluid pressure against the rupture disk 250 may increase as a result of a blockage in the downhole tool assembly 110 and/or the coiled tubing 270 of any blockages. The rupture disk 250 may be designed to burst at a pre-selected threshold pressure in order to increase fluid circulation and free the downhole tool assembly 110 and/or the coiled tubing 270 of any blockages. The pressure threshold may be sufficiently high such that normal operations performed by the downhole tool assembly 110 do not burst the rupture disk 250. In one or more aspects, in case of blockage in the downhole tool assembly 110, fluid pressure may be increased so that fluid pressure pressing against the rupture disk 250 increases beyond the threshold to burst the disk in order to increase fluid circulation and clear the blockage.

In one or more aspect, the downhole tool assembly 110 is customizable for a variety of fluids with varying viscosities. For example, one or more aspects of the downhole tool assembly 110 may be adjusted or adapted to suit a particular fluid viscosity, including but not limited to, the size of the ports 230 at the piston base 222, the size of the ports 234 at the stabilizer 232 and the tension of the spring 228.

Figure 3:
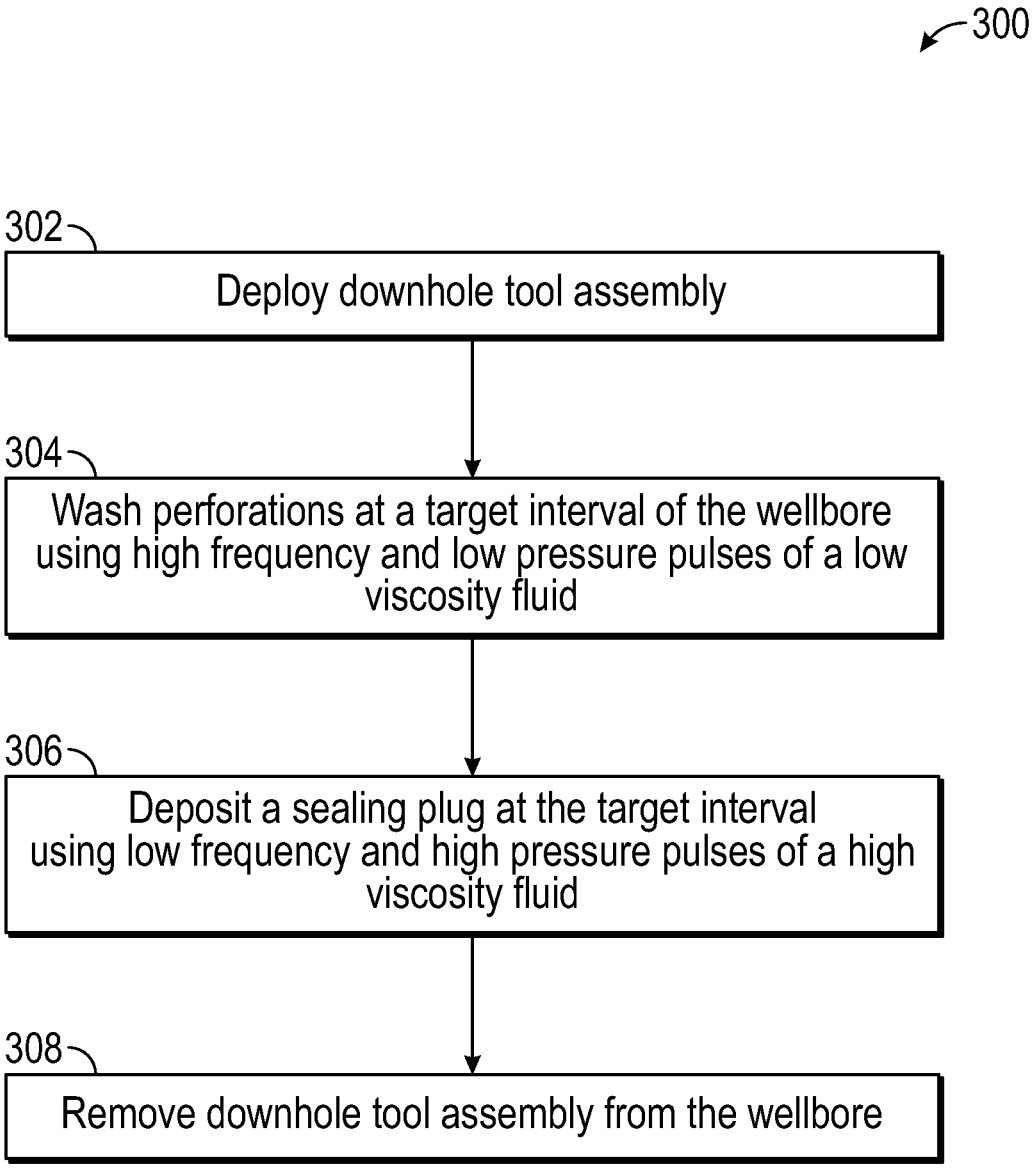
FIG. 3 is a flow chart of a method for operating a downhole tool assembly, in accordance with certain aspects of the present disclosure.

FIG. 3 is a flow chart of a method 300 for operating a downhole tool assembly (e.g., downhole tool assembly 110), in accordance with certain aspects of the present disclosure.

The method 300 begins, at 302, by deploying the downhole tool assembly 110 within the wellbore 108. In one or more aspects, the downhole tool assembly 110 may be deployed within the wellbore 108 using the coiled tubing system 120, a jointed pipe system, or any other system capable of deploying the downhole tool assembly 110 within the wellbore 108.

At 304, the wash tool 210 washes the target interval 114 of the wellbore 108 with pulses of a low viscosity fluid such as acid and/or brine at a first frequency and first pressure. As described above, the wash tool 210 may use fluid oscillator technology to clean debris from perforations or slots 140 in the casing 116 in order to prepare the target interval 114 for the cementing process associated with installing the cement plug. For example, the wash tool 210 may jet oscillating water, brine, spotting acid, solvent, or other low viscosity cleaning agents at the target interval 114 to remove any perforating debris or material buildup away from the target interval 114. By removing the debris and buildup from the target interval 114, sealing communication between the cement plug and the formation 104 may be improved.

In one or more aspects, after a perforating or slotting operation is completed at the target interval 114 by a perforating or slotting tool, a low viscosity fluid such as brine or acid may be pumped in the flow direction 280 through the coiled tubing 270 into the downhole tool assembly 110. The low viscosity fluid flows through the plugging tool 220 into the wash tool 210 and is diverted to one of more oscillating side ports 212 of the wash tool 210. The oscillating side ports 212 transmit fluid into the wellbore 108 in an oscillating manner to provide a thorough flush of the perforations or slots 140 cut through the casing 116. The pressure pulses may include high frequency pulses (e.g., 100 Hz to 300 Hz) at low fluid pressures with a flow rate in the range of 0.25 barrels (bbl)/min and 10 bbl/min. The high frequency low pressure fluid pulses output from the oscillating side ports 212 may help break up any consolidated fill within the perforations or the slots 140, and the pulse and flow aspect of the cyclic output may also provide an ability to flush any fill from irregular channels or profiles of the perforations or the slots 140.

At 306, a sealing plug (e.g., a cement plug) is deposited at the target interval 114 with pulses of a high viscosity fluid (e.g., cement) at a second frequency and a second pressure generated by a plugging tool 220 configured uphole from the wash tool 210. In one or more aspects, the plugging tool 220 is designed to place a cement plug at the target interval 114 in sealing communication with the formation 104. In one or more aspects, once the perforations 140 have been cleaned by the wash tool 210, cement may be pumped via the coiled tubing 270 into the downhole tool assembly 110. The cement may exit one or more cement ports 214 of the plugging tool 220 into the wellbore 108 and occupy the target interval 114 of the wellbore to provide the sealing communication with the formation 104. In one or more aspects, the plugging tool 220 can generate low frequency and high amplitude (e.g., high pressure) pulses of high viscosity fluids such as cement slurry to provide better injectivity and penetration of the high viscosity fluids into perforations 140 and micro annulus within the wellbore. This allows the plugging tool to provide a better seal as compared to the existing plugging tools. The high viscosity fluid (e.g., higher viscosity than the low viscosity fluids jetted by the wash tool 210) are pulsed by the plugging tool 220 at a frequency that is lower than the frequency of pulses generated by the wash tool 210 and are at a higher pressure than the pressure of pulses from the wash tool 210. For example, the plugging tool 220 may produce fluid pulses with frequency ranging from 1 to 20 Hz, fluid pressure greater than 500 PSI and flow rate of the fluid ranging from 0.5 to 10 bbl/min.

At 308, the downhole tool assembly 110 is removed from the wellbore 108. Removing the downhole tool assembly 110 from the wellbore 108 may involve withdrawing the coiled tubing 118 and the downhole tool assembly 110 in an uphole direction until the downhole tool assembly 110 is positioned within the lubricator 134. When the downhole tool assembly 110 is positioned within the lubricator 134, a valve connecting the lubricator 134 to the wellbore 108 may be closed and the pressure within the lubricator 134 is bled off. When a pressure differential between the lubricator 134 and the outside environment reaches zero, the lubricator 134 may be detached from the blowout preventer 130 or the wellhead 128 such that the downhole tool assembly 110 is accessible for rigging down.

Embodiments of the methods disclosed in the method 300 may be performed in the operation of the downhole tool assembly 110. The order of the blocks presented in the method 300 above can be varied—for example, blocks can be reordered, combined, removed, and/or broken into sub-blocks. Certain blocks or processes can also be performed in parallel.

As discussed above, FIGS. 2A and 2B and the method of FIG. 3 relate to an example of a plugging tool 220 in fluid communication with the wash tool and configured for depositing a second fluid at the target interval of the wellbore to form a sealing plug. One aspect of the described mechanism of the plugging tool 220 may be described as a fluid pulse generator in that it generates pulses of a sealing fluid at a frequency and a pressure. Another aspect of the described mechanism of the plugging tool 220 may be described as an obturation mechanism in that it generates these fluid pulses by alternately interrupting and releasing the flow of the second fluid through a fluid passage. Alternative plugging tools are now shown in FIGS. 4-6 comprising different fluid pulse generators and obturation mechanisms.

Figure 4:
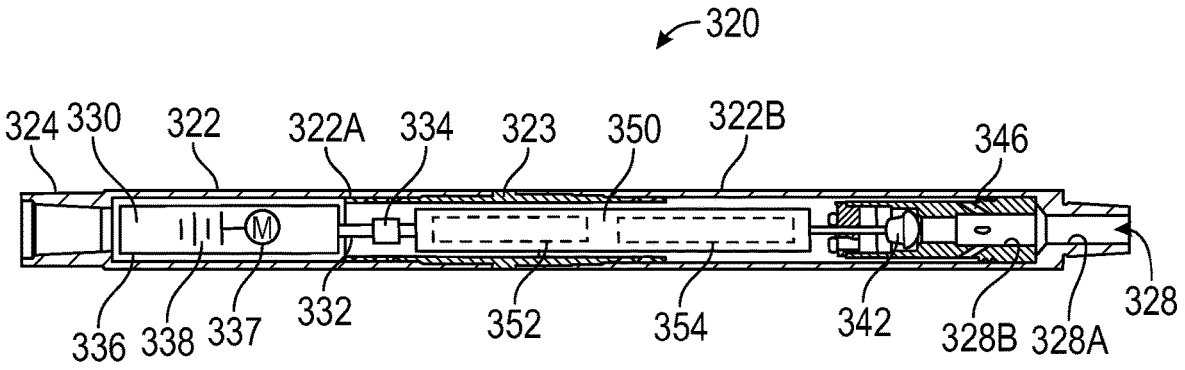
FIG. 4 is a cross-sectional side view of another example of a plugging tool having an electric motor-driven, plunger-based obturation mechanism for delivering pulsed sealing fluid to a target interval of a wellbore.

FIG. 4 is a cross-sectional side view of another example of a plugging tool 320 having an electric motor-driven, plunger-based obturation mechanism for delivering pulsed sealing fluid to a target interval of a wellbore. The plugging tool 320 may be used as an alternative to any of the plugging tools of preceding figures, either alone or in combination with a wash tool such as described in the preceding figures. For example, the wash tool 210 of FIGS. 2A and 2B may be coupled to the plugging tool 320 for washing a target interval using a first fluid, which may comprise a wash fluid (e.g., acid or brine). The plugging tool 320 may then be used as described below to deliver pulses of a second fluid, which may comprise a more viscous, sealing fluid (e.g., a cement). In other examples, the plugging tool 320 itself may be used to generate the fluid pulses of the wash fluid at one frequency, and fluid pulses of the sealing fluid at another frequency, without the need for a separate wash tool.

The plugging tool 320 includes a housing 322 for supporting various plugging tool components. The housing 322 may be assembled from multiple housing sections, which in this example includes two (e.g., upper and lower) housing sections 322A, 322B that may be coupled at a joint 323. The housing 322 includes an upstream end (i.e., inlet end) 324, as defined by the upstream housing section 322A in this example. The inlet end 324 may be coupled directly or indirectly to coiled tubing or other conveyance. The housing 322 also includes a downstream end (i.e., outlet end) 326, as defined by the downstream housing section 322B in this example. The downstream end 326 defines at least a portion 328A of a fluid passage 328 through which fluids may pass out of the housing 322. For example, a wash fluid may first be pumped through the housing 322, which may be pulsed using a wash tool, for washing a target interval. Then, the plugging tool 320 may be used as described below for delivering pulses of a sealing fluid to the target interval to form a sealing plug.

Plugging tool components supported on or in the housing 322 in this example include an electric motor 330, an obturation mechanism 340 driven by the electric motor 330 for generating fluid pulses in that fluid flow, and a dynamic coupling mechanism 350 for converting an output of the electric motor to an appropriate input to the obturation mechanism 340. These components are illustrated as being generally aligned with one another and centrally positioned within the through bore 325 of the housing 322. However, alternative configurations could have one or more of these plugging tool components in different positions and orientations relative to each other and/or to the housing 322. For example, because the electric motor 330 is driven by electricity and not by fluid flow through the housing 322, the electric motor 330 is not required to be aligned with the flow through the housing 322. The electric motor 330 could instead be relocated from what is shown and even positioned in a separate housing and/or outside of the plugging tool's housing 322 if a particular tool design or design envelope called for it.

The schematically shown electric motor 330 may represent any of a variety of suitable motors for downhole use.

The electric motor 330 may comprise a motor housing 336, which may be sealed to keep out fluids and contaminants. The motor housing 336 may house internals of the electric motor 337, e.g., an armature with one or more coil windings, or the like. The motor housing 336 may also house an electromotive source 338, e.g., a battery or a connection to an external downhole electrical power source (if available). As fluid flows through the housing 322, the fluid may flow around the sealed motor housing 336 and to downstream components, such as around a DCM 350 and to the obturation mechanism 340.

The obturation mechanism 340 generates fluid pulses by alternately interrupting and releasing flow through the housing 322 via reciprocation of a plunger 342. Specifically, the plunger 342 is moveable to block and unblock the fluid passage 328, which, in this example, includes a portion 328A defined by the housing 322 and a portion 328B defined by a flow body 344 in which the plunger 342 reciprocates. The rotation of the electric motor is used to drive the reciprocation of the plunger 342. With each cycle, the obturation mechanism 340 generates a significant fluid pressure increase by momentarily interrupting the flow, which is then forcefully released by unblocking the fluid passage 328. This release of fluid pressure generates a pulse in the relatively high-viscosity sealing fluid. The fluid pulses generated may be delivered through the fluid passage 328 such as to one or more cement ports as described in foregoing embodiments.

The plunger 342 resembles a piston in some respects, such as the axial reciprocation within a bore. However, unlike a piston, the plunger 342 is not required to remain in sealing contact with a bore through its entire stroke. The linear reciprocation of the plunger 342 is generally aligned with an axis of the housing 322 and of the flow passage 328 in this example. However, other embodiments may orient a plunger transverse to the axis of the housing and/or of the flow passage 328. For example, a plunger within the scope of this disclosure could alternatively function as a gate to momentarily block and unblock a fluid passage.

Significant pressure may be generated in the housing 322 by the obturation mechanism 340 in view of the fluid pressure supplied to the plugging tool in order to flow the relatively viscous sealing fluid. A relatively high pressure is useful for generating effective fluid pulses in the cement or other sealing fluid. The flow body is shown as including an optional fluid bypass 346 arranged to pass a portion of the flow around the plunger 324 to the fluid passage 328 when interrupted by the obturation mechanism 340. The fluid bypass 346 may be omitted in some configurations but may be useful in at least some configurations if it is desired to maintain at least some flow through the housing even when the flow is blocked.

An electric motor shaft 332 may be coupled to an input end of the dynamic coupling mechanism 350 via an adapter 334. The dynamic coupling mechanism 350 is used to convert an output of the electric motor 330 to an appropriate input for the obturation mechanism 340. At least in this non-limiting example, the output of the electric motor 330 comprises a rotation of the electric motor shaft 332, while the motion of the plunger 342 is linear. Also, the rotational frequency, e.g., in terms of revolutions per minute (RPMs) of the electric motor 330 may be higher than a desired pulsing frequency for the sealing fluid. Therefore, the dynamic coupling mechanism 350 may include a rotary-to-linear converter schematically indicated at 352 and a gear-based reduction mechanism schematically depicted at 354. The rotary-to-linear converter 352 comprises any suitable mechanism to convert the rotation of the motor shaft 332 to a linear reciprocation used to operate the plunger 342. Non-limiting examples of a rotary-to-linear converter may comprise, for example, a cam or camshaft, a rack and pinion, a screw and linearly translating nut, one or more gears, a combination of the foregoing, or any other suitable mechanism that may be generally understood in the art apart from specific teachings of this disclosure for converting between rotational motion and linear motion. The reduction mechanism 354 may comprise gearing or any other suitable mechanism to reduce a speed (and associated frequency) of the plunger 342 with respect to a speed (and associated frequency) of the electric motor 330. This allows a relatively high speed electric motor to achieve a desired, lower pulsing frequency for delivering the sealing fluid to the target interval to be plugged. Reducing the motor speed may also desirably produce an increase in torque to drive the obturation mechanism 340. Although the rotary-to-linear converter 352 and reduction mechanism 354 are functionally separated for discussion in this figure, they may be embodied in a single dynamic coupling mechanism 350 that both converts the rotation at a rotational frequency of the electric motor shaft 332 to a reciprocation at a desired pulsing frequency for the obturation mechanism 340.

Figure 5:
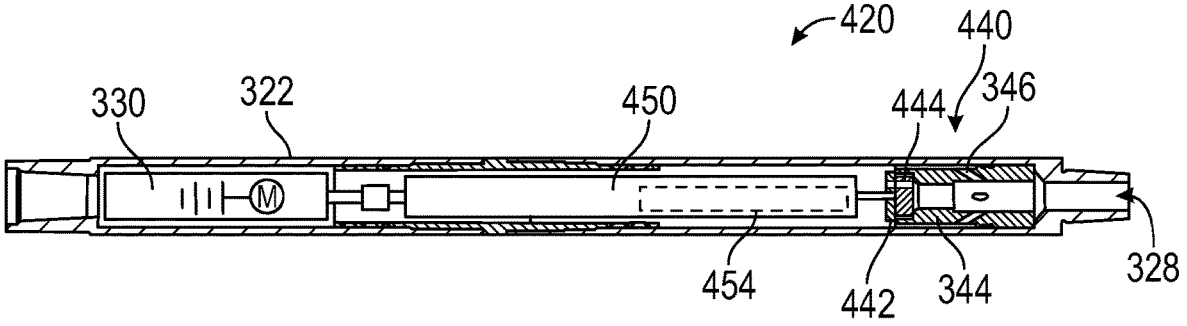
FIG. 5 is a cross-sectional side view of another example of a plugging tool having an electric motor-driven, rotary plate-based obturation mechanism for delivering pulsed sealing fluid to a target interval of a wellbore.

FIG. 5 is a cross-sectional side view of another example of a plugging tool 420 having an electric motor-driven, rotary plate-based obturation mechanism for delivering pulsed sealing fluid to a target interval of a wellbore. The plugging tool 420 may also be used as an alternative to any of the plugging tools of preceding figures, and in combination with a wash tool such as described in the preceding figures. For example, the wash tool 210 of FIGS. 2A and 2B may be coupled to the plugging tool 420 for washing a target interval with a wash fluid and then used to deliver pulses of a sealing fluid. For ease of discussion, the housing 322 and the electric motor 330 may be the same or functionally similar to those described in the plugging tool 320 of FIG. 4. Plugging tool components are again illustrated as being generally aligned with one another and centrally positioned within the housing 322, but could be in different positions and orientations relative to each other and/or to the housing 322.

The obturation mechanism 440 in this example uses one or more rotary plates rather than a linearly reciprocating plunger for alternately interrupting and releasing flow through the housing 322. Specifically, the obturation mechanism 440 includes at least one rotary plate 442 that has an aperture (discussed below) moveable into and out of fluid communication with the fluid passage 328. The obturation mechanism 440 in this example optionally further includes a second plate, which may be a stationary plate 444, also having an aperture aligned with the fluid passage 328. The rotary plate 442 is rotatable by the electric motor 330 to move the aperture into and out of fluid communication with the fluid passage 328. With each rotational cycle of the rotary plate 442, the obturation mechanism 440 generates a significant fluid pressure increase by momentarily interrupting the flow by blocking the fluid passage 328, which is then forcefully released by unblocking the fluid passage 328. This release of fluid pressure generates a pulse in the relatively high-viscosity sealing fluid. The flow body 344 may be the same or functionally similar as that of FIG. 4. For example, the fluid bypass 346 may again be included if desired, similar to the example of FIG. 4, to pass a portion of the flow to the fluid passage 328 downstream of the rotary plate 442 when interrupted by the obturation mechanism 340.

The electric motor shaft 332 may be coupled to an input end of the dynamic coupling mechanism 450 via an adapter 334. The dynamic coupling mechanism 450 is used to convert an output of the electric motor 330 to an appropriate input for the obturation mechanism 440. In this example, the output of the electric motor 330 and the motion of the rotary plate 442 are both rotational, avoiding the need for a rotary-to-linear converter. However, the dynamic coupling mechanism 450 may at least include a gear-based reduction mechanism schematically depicted at 454 to reduce a speed (and associated frequency) of the rotary plate 442 with respect to a speed (and associated frequency) of the electric motor 330. This allows a relatively high speed electric motor to achieve a desired, lower pulsing frequency (and higher torque) for delivering the sealing fluid to the target interval to be plugged.

Figure 6:
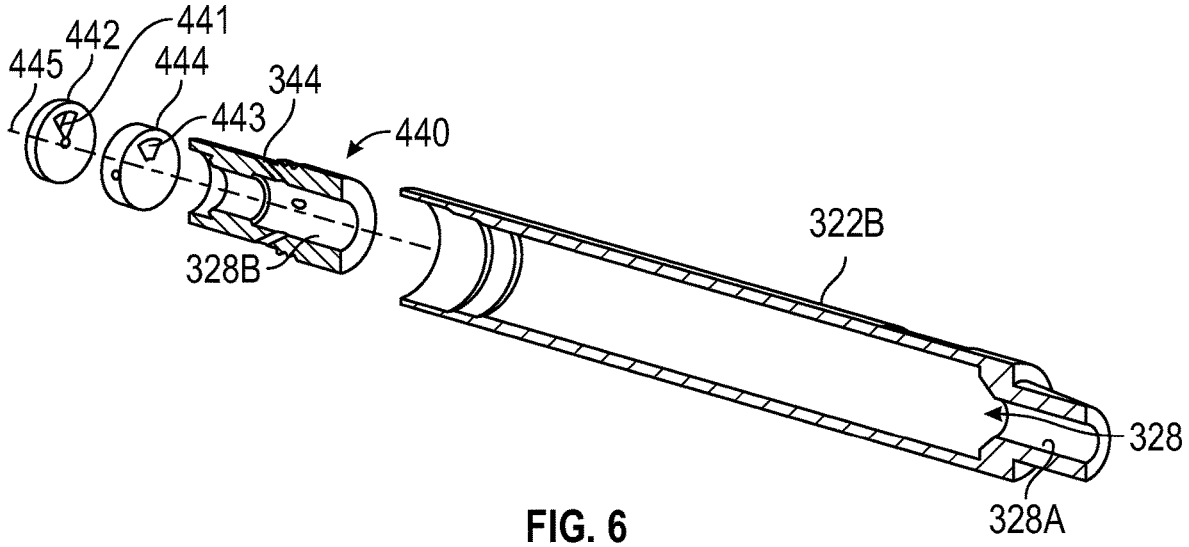
FIG. 6 is a perspective, exploded view of the obturation mechanism of FIG. 5 juxtaposed with the lower housing section.

FIG. 6 is a perspective, exploded view of the obturation mechanism 440 of FIG. 5 juxtaposed with the lower housing section 322B. The lower housing section 322B may be considered part of the obturation mechanism 440 at least in that it may define the portion 328A of the fluid passage 328 together with the portion 328B defined by the flow body 344. This view shows the aperture 441 on the rotary plate 442 aligned with the aperture 443 on the stationary plate 444. The apertures 441, 443 are radially spaced from a rotational axis 445 of the stationary plate 442. The aperture 443 on the stationary plate 444 may be secured to the flow body 344 to remain in fluid communication with the fluid passage 328 as the rotary plate 442 rotates with respect to the stationary plate 444. Accordingly, a rotation of a first plate (the rotary plate 442) by the electric motor moves the aperture 441 on the rotary plate 442 into and out of fluid communication with the aperture 443 on the stationary plate 444 to alternately interrupt and release flow through the housing and particularly to generate fluid pulses delivered through the fluid passage 328 such as to one or more cement ports as described in foregoing embodiments.

An apparatus such as described in the examples of FIGS. 4-6 may be useful in a method for sealing a wellbore. The method may include driving a rotation of an electric motor, which may or may not be immersed (within a sealed batter housing) in a flow of a sealing fluid through the housing of the plugging tool. The rotation of the electric motor may be used to drive an obturation mechanism to alternately interrupt and release a flow of the sealing fluid through a fluid passage thereby generating pulses at a frequency and a pressure. The sealing fluid may be deposited at a target interval, wherein the sealing fluid is solidifiable into a sealing plug at the target interval.

Prior to depositing the sealing fluid, the target interval of the wellbore may washed using a wash tool to deliver pulses of the wash fluid at a higher frequency and pressure than the pluses in the sealing fluid. A pressure activated sleeve may be operated as described in foregoing embodiments after washing the interval to open at least one cement port. The sealing fluid may then be delivered to the target interval through the at least one cement port. Operating the pressure activated sleeve may comprise increasing a pumping rate of the wash fluid to increase a pressure of the wash fluid beyond a threshold pressure. Alternatively, operating the pressure activated sleeve may comprise pumping the sealing fluid to increase a pressure of the second fluid beyond a threshold pressure.

In some cases the plugging tool of FIGS. 4-6 could be used to generate fluid pulses for the wash fluid without the need for a separate wash tool. For example, the electric motor could be operable at different motor speeds, so as to generate higher frequency pulses for the wash fluid and lower frequency pulses for the sealing fluid. In other examples, the reduction mechanism may comprise a variable-speed reduction mechanism that adjusts the input to the obturation mechanism to generate higher-frequency fluid pulses for the wash fluid and lower-frequency pulses for the sealing fluid. Alternatively, the obturation mechanism could be driven at substantially the same speed as the electric motor for pulsing wash fluid, such as using a direct drive, and selectively engaging the reduction mechanism to reduce that frequency when pulsing the sealing fluid.

The plugging tools 320, 420 of FIGS. 4-6 thereby comprise examples of a fluid pulse generator for generating pulses of a high viscosity sealing fluid and optionally generating pulses of a lower viscosity wash fluid. The fluid pulse generator may comprise an electric motor and an obturation mechanism (plunger or rotary plate) driven by the electric motor to generate pulses of the sealing fluid having a frequency and a pressure by alternately interrupting and releasing the flow of the sealing fluid through a fluid passage.

As used below, any reference to a series of examples is to be understood as a reference to each of those examples disjunctively (e.g., "Examples 1-4" is to be understood as "Examples 1, 2, 3, or 4").

Example 1 is a downhole tool, comprising: a wash tool configured at a downhole end of the downhole tool to generate pulses of a first fluid at a first frequency and a first pressure for washing a target interval of a wellbore; and a plugging tool configured uphole from the wash tool to generate pulses of a second fluid at a second frequency and a second pressure for depositing a sealing plug at the target interval of the wellbore, wherein: the second fluid has a higher viscosity than the first fluid; the second frequency is lower than the first frequency; and the second pressure is higher than the first pressure.

Example 2 is a downhole tool of example 1, further comprising: a pressure activated sleeve configured between the wash tool and the plugging tool, wherein the pressure activated sleeve is configured to open at least one cementing port of the downhole tool when a pressure of the first fluid or the second fluid is increased in a chamber adjacent to the pressure activated sleeve beyond a threshold pressure.

Example 3 is a downhole tool of examples 1 or 2, wherein the plugging tool comprises a low frequency generator for generating the pulses of the second fluid, wherein the low frequency generator comprises: a piston including a piston base, a piston shaft and a piston head, wherein the piston is configured to move laterally along the length of the low frequency generator; a stabilizer configured near a neck portion of the piston near the piston head, wherein the stabilizer is configured to allow lateral movement of the piston shaft while supporting the shaft; a spring positioned between the piston base and the piston head such that the spring pushes against the piston base away from an opening of the low frequency generator at a downhole end of the low frequency generator, wherein the opening of the low frequency generator allows the second fluid to flow from the low frequency generator into the chamber adjacent to the pressure activated sleeve, and wherein the pulses of the second fluid exit from the chamber through the at least one cementing port.

Example 4 is a downhole tool of examples 3, wherein the piston base comprises one or more ports to allow the second fluid to flow downhole through the piston base.

Example 5 is a downhole tool of any of the examples 3 to 4, wherein the stabilizer comprises one or more ports to allow the second fluid to flow downhole through the stabilizer.

Example 6 is a downhole tool of any of the examples 3 to 5, wherein when the spring is in a fully open position, the spring has the piston base pushed to a leftmost position of the piston base such that the piston head does not obstruct the opening.

Example 7 is a downhole tool of any of the examples 3 to 6, wherein the low frequency generator generates the pulses of the second fluid by cycling through operations comprising: when the second fluid is pumped into the low frequency generator from an uphole end of the low frequency generator, the second fluid pushes the piston towards the downhole end of the low frequency generator such that the piston head seals against the opening of the low frequency generator and obstructs the flow of the second fluid; in response to the flow of the second fluid being obstructed, the spring pushes back the piston head towards the uphole end to move the piston head away from the opening and restoring the flow of the second fluid.

Example 8 is a downhole tool of any of the examples 1 to 7, further comprising: a rupture disk configured uphole from the plugging tool to clear blockages in a work string coupled to the downhole tool as a result of accumulation of at least one of the first fluid or the second fluid in the downhole tool, wherein the rupture disk bursts when a pressure of a least one of the first fluid or the second fluid is increased against the rupture disk beyond a threshold pressure.

Example 9 is a downhole tool of any of the examples 1 to 8, wherein the second frequency is in the range of 1 Hz to 20 Hz and the second pressure is greater than 500 psi.

Example 10 is a method for sealing a wellbore using a downhole tool, comprising: washing a target interval of a wellbore with pulses of a first fluid at a first frequency and a first pressure generated by a wash tool at a downhole end of the downhole tool; and depositing a sealing plug made of a solidified second fluid at the target interval with pulses of the second fluid at a second frequency and a second pressure generated by a plugging tool configured uphole from the wash tool, wherein: the second fluid has a higher viscosity than the first fluid; the second frequency is lower than the first frequency; and the second pressure is higher than the first pressure.

Example 11 is a method of example 10, wherein the downhole tool comprises a pressure activated sleeve configured between the wash tool and the plugging tool, wherein the pressure activated sleeve is configured to open at least one cementing port of the downhole tool when a pressure of the first fluid or the second fluid is increased in a chamber adjacent to the pressure activated sleeve beyond a threshold pressure.

Example 12 is a method of example 11, further comprising opening the pressure activated sleeve by increasing a pumping rate of the first fluid into the downhole tool to increase the pressure of the first fluid in the chamber beyond the threshold pressure.

Example 13 is a method of any of the examples 11 to 12, further comprising opening the pressure activated sleeve by pumping the second fluid into the downhole tool to increase the pressure of the second fluid in the chamber beyond the threshold pressure.

Example 14 is a method of any of the examples 11 to 13, wherein the plugging tool comprises a low frequency generator for generating the pulses of the second fluid, wherein the low frequency generator comprises: a piston including a piston base, a piston shaft and a piston head, wherein the piston is configured to move laterally along the length of the low frequency generator; a stabilizer configured near a neck portion of the piston near the piston head, wherein the stabilizer is configured to allow lateral movement of the piston shaft while supporting the shaft; a spring positioned between the piston base and the piston head such that the spring pushes against the piston base away from an opening of the low frequency generator at a downhole end of the low frequency generator, wherein the opening of the low frequency generator allows the second fluid to flow from the low frequency generator into the chamber adjacent to the pressure activated sleeve, and wherein the pulses of the second fluid exit from the chamber through the at least one cementing port.

Example 15 is a method of any of the examples 11 to 14, further comprising generating the pulses of the second fluid using the low frequency generator by pumping the second fluid into the low frequency generator from an uphole end of the low frequency generator, wherein the low frequency generator generates the pulses of the second fluid by cycling through operations comprising: when the second fluid is pumped into the low frequency generator, the second fluid pushes the piston towards the downhole end of the low frequency generator such that the piston head seals against the opening of the low frequency generator and obstructs the flow of the second fluid; and in response to the flow of the second fluid being obstructed, the spring pushes back the piston head towards the uphole end to move the piston head away from the opening and restoring the flow of the second fluid.

Example 16 is a plugging tool for depositing a sealing plug at a target interval of a wellbore, comprising: a low frequency generator for generating pulses of a high viscosity fluid, wherein the low frequency generator comprises: a piston including a piston base, a piston shaft and a piston head, wherein the piston is configured to move laterally along the length of the low frequency generator; a stabilizer configured near a neck portion of the piston near the piston head, wherein the stabilizer is configured to allow lateral movement of the piston shaft while supporting the shaft; and a spring positioned between the piston base and the piston head such that the spring pushes against the piston base away from an opening of the low frequency generator at a downhole end of the low frequency generator.

Example 17 is a plugging tool of example 16, wherein the low frequency generator generates the pulses of the high viscosity fluid by cycling through operations comprising: when the high viscosity fluid is pumped into the low frequency generator from an uphole end of the low frequency generator, the high viscosity fluid pushes the piston towards the downhole end of the low frequency generator such that the piston head seals against the opening of the low frequency generator and obstructs the flow of the high viscosity fluid; and in response to the flow of the high viscosity fluid being obstructed, the spring pushes back the piston head towards the uphole end to move the piston head away from the opening and restoring the flow of the high viscosity fluid, wherein the opening of the low frequency generator allows the high viscosity fluid to exit the low frequency generator.

Example 18 is a plugging tool of example 17, further comprising: a pressure activated sleeve configured downhole from the low frequency generator and adjacent to the opening of the low frequency generator, wherein: the pressure activated sleeve receives flow of the high viscosity fluid from the low frequency generator via the opening of the low frequency generator into a chamber adjacent to the pressure activated sleeve; and the pressure activated sleeve is configured to open at least one cementing port of the downhole tool when a pressure of the high viscosity fluid is increased in the chamber adjacent to the pressure activated sleeve beyond a threshold pressure.

Example 19 is a plugging tool of any of the examples 17 to 18, wherein the piston base comprises one or more ports to allow the high viscosity fluid to flow downhole through the piston base.

Example 20 is a downhole tool of any of the examples 17 to 18, wherein a frequency of the pulses is in the range of 1 Hz to 20 Hz and a pressure of the pulses is in the range of 400 psi to 2000 psi.

Example 21. A downhole tool, comprising: a wash tool configured to generate pulses of a first fluid at a first frequency and a first pressure for washing a target interval of a wellbore; and a plugging tool in fluid communication with the wash tool and configured for depositing a second fluid at the target interval of the wellbore to form a sealing plug, the plugging tool including an electric motor and an obturation mechanism driven by the electric motor to generate pulses of the second fluid at a second frequency and a second pressure by alternately interrupting and releasing the flow of the second fluid through a fluid passage.

Example 22. The downhole tool of example 21, wherein the obturation mechanism comprises a rotary plate with an aperture rotatable by the electric motor into and out of fluid communication with the fluid passage.

Example 23. The downhole tool of example 22, wherein the obturation mechanism further comprises a stationary plate with an aperture aligned with the fluid passage, wherein rotation of the first plate by the electric motor moves the aperture on the rotary plate into and out of fluid communication with the aperture on the stationary plate.

Example 24. The downhole tool of any of examples 21-23, wherein the obturation mechanism comprises a plunger reciprocable by the electric motor to alternately block and unblock the fluid passage.

Example 25. The downhole tool of example 24, further comprising: a rotary to linear converter coupled between an electric motor shaft and the plunger to convert a rotation of the electric motor shaft to a reciprocation of the plunger.

Example 26. The downhole tool of any of examples 21-25, further comprising a reducer mechanism coupled between the electric motor and the obturation mechanism to reduce a frequency of the obturation mechanism with respect to a frequency of the electric motor.

Example 27. The downhole tool of any of examples 21-26, wherein the plugging tool further comprises a housing, with the obturation mechanism arranged in the housing and with the fluid passage defined by a downstream end of the housing.

Example 28. The downhole tool of example 27, wherein the electric motor is arranged in the housing in line with the obturation mechanism.

Example 29. The downhole tool of any of examples 21-28, further comprising a pressure activated sleeve configured to open at least one cement port for depositing the second fluid to the target interval when a pressure of the first fluid or the second fluid is increased in a chamber adjacent to the pressure activated sleeve beyond a threshold pressure.

Example 30. The downhole tool of example 29, wherein the fluid passage of the plugging tool allows the second fluid to flow from the plugging tool into the chamber adjacent to the pressure activated sleeve, and wherein the pulses of the second fluid exit from the chamber through the at least one cement port.

Example 31. The downhole tool of any of examples 21-30, further comprising:

a rupture disk configured uphole from the plugging tool to clear blockages in a work string coupled to the downhole tool as a result of an accumulation of at least one of the first fluid or the second fluid, wherein the rupture disk bursts when a pressure of a least one of the first fluid or the second fluid is increased against the rupture disk beyond a threshold pressure.

Example 32. The downhole tool of any of examples 21-31, wherein the first frequency is in a range of 10 to 400 Hz, the second frequency is in a range of 1 Hz to 20 Hz, and the second pressure is greater than 500 psi.

Example 33. A method for sealing a wellbore, comprising: generating a flow of a sealing fluid; using an electric motor to drive an obturation mechanism to alternately interrupt and release the flow of the sealing fluid through a fluid passage thereby generating pulses at a frequency and a pressure; and depositing the sealing fluid at a target interval, wherein the sealing fluid is solidifiable into a sealing plug at the target interval.

Example 34. The method of example 33, further comprising: before depositing the sealing fluid, washing the target interval of a wellbore with pulses of a wash fluid at a higher frequency and pressure than the pluses in the sealing fluid.

Example 35. The method of example 34, further comprising: operating a pressure activated sleeve after washing the interval to open at least one cement port; and depositing the sealing fluid to the target interval through the at least one cement port.

Example 36. The method of example 35, wherein operating the pressure activated sleeve comprises increasing a pumping rate of the wash fluid or the sealing fluid to increase a pressure of the wash fluid beyond a threshold pressure.

Example 37. The method of example 35 or 36, wherein operating the pressure activated sleeve comprises closing the at least one wash port.

Example 38. A plugging tool for depositing a sealing plug at a target interval of a wellbore, comprising: a fluid pulse generator for generating pulses of a high viscosity sealing fluid, wherein the fluid pulse generator comprises: a housing; and an obturation mechanism in the housing driven by the electric motor to generate pulses of the sealing fluid having a frequency and a pressure by alternately interrupting and releasing the flow of the sealing fluid through a fluid passage.

Example 39. The plugging tool of example 38, further comprising: a pressure activated sleeve coupled to the fluid pulse generator adjacent to the fluid passage, wherein: the pressure activated sleeve receives flow of the high viscosity sealing fluid from the fluid pulse generator via the fluid passage into a chamber adjacent to the pressure activated sleeve; and the pressure activated sleeve is configured to open at least one cement port when a pressure of the high viscosity sealing fluid in the chamber is increased beyond a threshold pressure.

40. The downhole tool of example 38 or 39, wherein the fluid pulse generator is operable to pulse a wash fluid at a first frequency and to pulse the sealing fluid at a second frequency, wherein the first frequency is in a range of 10 to 400 Hz and the second frequency is in a range of 1 Hz to 20 Hz.

Therefore, the present disclosure is well adapted to attain the ends and advantages mentioned as well as those that are inherent therein. The particular aspects disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the elements that it introduces.

What is claimed is:

1. A downhole tool, comprising:

a wash tool configured to generate pulses of a first fluid at a first frequency and a first pressure for washing a target interval of a wellbore; and a plugging tool in fluid communication with the wash tool and configured for depositing a second fluid at the target interval of the wellbore to form a sealing plug, the plugging tool including an electric motor and an obturation mechanism driven by the electric motor to generate pulses of the second fluid at a second frequency and a second pressure by alternately interrupting and releasing the flow of the second fluid through a fluid passage, and wherein the obturation mechanism comprises a plunger reciprocable by the electric motor to alternately block and unblock the fluid passage.

2. The downhole tool of claim 1, wherein the obturation mechanism comprises a rotary plate with an aperture rotatable by the electric motor into and out of fluid communication with the fluid passage.

3. The downhole tool of claim 2, wherein the obturation mechanism further comprises a stationary plate with an aperture aligned with the fluid passage, wherein rotation of the first plate by the electric motor moves the aperture on the rotary plate into and out of fluid communication with the aperture on the stationary plate.

4. The downhole tool of claim 1, further comprising:

a rotary to linear converter coupled between an electric motor shaft and the plunger to convert a rotation of the electric motor shaft to a reciprocation of the plunger.

5. The downhole tool of claim 1, further comprising a reducer mechanism coupled between the electric motor and the obturation mechanism to reduce a frequency of the obturation mechanism with respect to a frequency of the electric motor.

6. The downhole tool of claim 1, wherein the plugging tool further comprises a housing, with the obturation mechanism arranged in the housing and with the fluid passage defined by a downstream end of the housing.

7. The downhole tool of claim 6, wherein the electric motor is arranged in the housing in line with the obturation mechanism.

8. The downhole tool of claim 1, further comprising a pressure activated sleeve configured to open at least one cement port for depositing the second fluid to the target interval when a pressure of the first fluid or the second fluid is increased in a chamber adjacent to the pressure activated sleeve beyond a threshold pressure.

9. The downhole tool of claim 8, wherein the fluid passage of the plugging tool allows the second fluid to flow from the plugging tool into the chamber adjacent to the pressure activated sleeve, and wherein the pulses of the second fluid exit from the chamber through the at least one cement port.

10. The downhole tool of claim 1, further comprising:

a rupture disk configured uphole from the plugging tool to clear blockages in a work string coupled to the downhole tool as a result of an accumulation of at least one of the first fluid or the second fluid, wherein the rupture disk bursts when a pressure of a least one of the first fluid or the second fluid is increased against the rupture disk beyond a threshold pressure.

11. The downhole tool of claim 1, wherein the first frequency is in a range of 10 to 400 Hz, the second frequency is in a range of 1 Hz to 20 Hz, and the second pressure is greater than 500 psi.

12. A method for sealing a wellbore, comprising:

generating a flow of a sealing fluid;

using an electric motor to drive an obturation mechanism to alternately interrupt and release the flow of the sealing fluid through a fluid passage thereby generating pulses at a frequency and a pressure;

depositing the sealing fluid at a target interval, wherein the sealing fluid is solidifiable into a sealing plug at the target interval; and before depositing the sealing fluid, washing the target interval of a wellbore with pulses of a wash fluid at a higher frequency and pressure than the pluses in the sealing fluid.

13. The method of claim 12, further comprising:

operating a pressure activated sleeve after washing the interval to open at least one cement port; and depositing the sealing fluid to the target interval through the at least one cement port.

14. The method of claim 13, wherein operating the pressure activated sleeve comprises increasing a pumping rate of the wash fluid or the sealing fluid to increase a pressure of the wash fluid beyond a threshold pressure.

15. The method of claim 13, wherein operating the pressure activated sleeve comprises closing the at least one wash port.

16. A plugging tool for depositing a sealing plug at a target interval of a wellbore, comprising:

a fluid pulse generator for generating pulses of a high viscosity sealing fluid, wherein the fluid pulse generator comprises:

a housing;

an electric motor, an obturation mechanism in the housing driven by the electric motor to generate pulses of the sealing fluid having a frequency and a pressure by alternately interrupting and releasing the flow of the sealing fluid through a fluid passage; and a reducer mechanism coupled between the electric motor and the obturation mechanism to reduce a frequency of the obturation mechanism with respect to a frequency of the electric motor.

17. The plugging tool of claim 16, further comprising:

a pressure activated sleeve coupled to the fluid pulse generator adjacent to the fluid passage, wherein:

the pressure activated sleeve receives flow of the high viscosity sealing fluid from the fluid pulse generator via the fluid passage into a chamber adjacent to the pressure activated sleeve; and the pressure activated sleeve is configured to open at least one cement port when a pressure of the high viscosity sealing fluid in the chamber is increased beyond a threshold pressure.

18. The downhole tool of claim 16, wherein the fluid pulse generator is operable to pulse a wash fluid at a first frequency and to pulse the sealing fluid at a second frequency, wherein the first frequency is in a range of 10 to 400 Hz and the second frequency is in a range of 1 Hz to 20 Hz.

* * * * *